US006106073A

United States Patent [19]

Simons et al.

[11] Patent Number: 6,106,073

[45] Date of Patent: Aug. 22, 2000

[54] SHIFTABLE WHEEL FOR ROAD MILLING MACHINE

[75] Inventors: Dieter Simons, Buchholz; Günter Hähn, Königswinter, both of Germany

[73] Assignee: Wirtgen GmbH, Windhagen, Germany

[21] Appl. No.: 09/043,975

[22] PCT Filed: Jun. 17, 1997

[86] PCT No.: PCT/EP97/03142

§ 371 Date: Mar. 31, 1998

§ 102(e) Date: Mar. 31, 1998

[87] PCT Pub. No.: WO98/05822

PCT Pub. Date: Feb. 12, 1998

[30] Foreign Application Priority Data

Aug. 1, 1996 [DE] Germany ..... 196 31 042

[51] Int. Cl.[7] ..... E01C 23/088

[52] U.S. Cl. ..... 299/39.6; 404/90; 180/209; 299/39.4

[58] Field of Search ..... 299/39.4, 39.6; 180/209; 404/90, 104

[56] References Cited

U.S. PATENT DOCUMENTS 3,188,026 6/1965 Perdue et al. ..... 180/209
3,306,390 2/1967 Jamme ..... 108/209
3,971,594 7/1976 Wirtgen ..... 299/39.6
4,966,418 10/1990 Wirtgen ..... 299/39.2

*Primary Examiner*—Eileen Dunn Lillis
*Assistant Examiner*—John Kreck
*Attorney, Agent, or Firm*—Knechtel, Demeur & Samlan

[57] ABSTRACT

A road construction machine for the treatment of roadways, comprising an automotive wheel frame consisting of a steerable frontal wheel frame axle (6) and two rear support wheels (14, 16) independent from each other, comprising a driver's platform (4), for a driver of the vehicle, arranged in the area of the rear support wheels (14, 16) and on a machine frame (8) supported by the wheel frame, comprising a working means (20) arranged in or on the machine frame (8) and roughly flush with the machine frame (8) on one side, namely the so-called zero extension side (24), comprising a driving motor for the driving power required for driving the driving means (20) and for moving the vehicle, the rear support wheel (16) arranged on the zero extension side being pivotable from an exterior end position (26) projecting beyond the zero extension side (24) to a retracted interior end position (28) where the support wheel (16) does not project beyond the zero extension side, provides that the pivotable support wheel (16) is pivotable from the exterior end position (28) to the interior end position (28) by means of a gear arranged in a horizontal plane.

12 Claims, 3 Drawing Sheets

SHIFTABLE WHEEL FOR ROAD MILLING MACHINE

The invention relates to a road construction machine for the treatment of roadways, e.g. roadway surfaces of concrete, asphalt or the like.

Such road construction machines are used, for example, as cold milling cutters for completing a roadway surface.

From DE 23 44 877 C3, a device for milling off roadway surfaces is known, wherein pivotable support wheels are fixed to a height-adjustable milling roller. The support wheel is pivoted about a vertical axis. The support wheel itself is also height-adjustable.

The pivoting position of the support wheel can be locked by means of bolts. These support wheels serve to keep constant the depth of milling of the milling roller. They are not driven and do not carry the machine weight, which is supported by the wheel frame.

In milling cutters of a more recent construction, an all-wheel drive is provided so that the support wheels usually arranged in the height of the milling roller are also driven. The support wheels are telescopic by means of hydraulic cylinders and carry the machine weight. The milling roller is arranged on the rear end of the machine frame and reaches, with its first frontal surface, close to the so-called zero extension side where the frontal surface of the milling roller is almost flush with the lateral edge of the machine frame. The milling roller thus is roughly flush and parallel to the rear side of the machine frame.

Because of the direct adjustability of the depth of milling, the support wheels are located on the height of the roller axis of the milling roller. In the case of a milling process occurring flush with the edges, the support wheel located on the zero extension side, which projects laterally beyond the zero extension side in a normal first end position, can be pivoted relatively to the machine frame to the inside so that work can take place near the edge. Pivoting the support wheel occurs about a vertical pivoting axis with the support wheel being attached to the machine frame in two places at a large vertical distance to obtain a sufficient stability to support the weight of the machine. The uniaxial mounting of the pivoting means projects relatively to the zero extension side so that it is possible to work near an edge but not to go as far as to be flush with the wall of a house.

The driver's platform is arranged on the machine frame above the milling roller. In the case of milling near edges on the zero extension side, the support wheel and the uniaxial mounting of the support wheel obstruct a free view on the working space in front of the milling roller both in the extended and especially in the retracted state. As the pivoting means requires a large amount of space, it is not possible to set a driver's cabin on the driver's platform. Furthermore, the operator has to mount and dismount at the back, which is disadvantageous for safety reasons. Another disadvantage is the fact that the rotational direction of the support wheel is changed by its being pivoted. Therefore, it is necessary to switch the rotational direction of the hydraulic drive for the support wheel, or the support wheel has to be mounted rotationally on the lifting column requiring an additional locking device.

The invention is based on the object to improve a road construction machine of the above kind such that, in the case of a support wheel pivotable on the zero extension side of the machine, the free view on the working space in front of the working means can be improved in the case of work near an edge.

The features of the invention serve to achieve this object.

Advantageously, the invention provides that the pivotable support wheel is pivotable by means of a gear arranged in a horizontal plane from a first exterior end position to the interior end position. By means of the horizontal position of the gear, the vertical space required for the pivoting means of the support wheel is reduced substantially, so that the support wheel with the pivoting means allows for a better view on the working space in front of the working means both in the extended and in the retracted state.

The gear can be arranged advantageously in a plane located below the driver's platform so that an unobstructed observation of the working surface in front of the working means is possible to the driver of the vehicle. The arrangement of the gear also allows for a driver's cabin to be set on the driver's platform, with the possibility to provide direct access to the driver's platform from the side.

Preferably, the pivotable support wheel is provided to be pivotable while maintaining the running direction, with the support wheel being displaced in parallel in the interior end position. Maintaining the running direction is advantageous in that the drive for the support wheel does not have to be switchable in the rotational direction thereof. For example, lifting columns with rectangular or square cross sections can be used which are more convenient where the directional stability is concerned. In the case of lifting columns with a circular cross section, the support wheel does not have to be turned by 180°.

The gear preferably consists of a guide rod gear. Such a gear can absorb high vertical forces in spite of a small vertical extension, as it can be supported on two horizontally spaced vertical bearings.

The guide rod gear can be coupled to a driving means so that pivoting the support wheel can be caused by the driver of the vehicle on the driver's platform by means of an operation console.

The guide rod gear can consist of a four-bar mechanism with four vertical articulated axles and with two guide rods pivotable in a horizontal plane. In the case of such a guide rod gear, the support weight is distributed, on the machine frame and on the support wheel, on two vertical articulated axles each so that the machine weight can be supported with high stability even if the vertical extension of the pivoting means is reduced.

The joints on the side of the machine are located in the machine frame and do not project relatively to the zero extension side. In this manner, it is possible not only to work near an edge but also to move such as to be flush with the wall of a house. As compared to a uniaxial embodiment of the pivoting means, a smaller lateral lift occurs between the two end positions of the support wheel so that the exterior end position of the support wheel requires less space, whereby the machine is not broadened unnecessarily.

The working means can consist of a milling roller one frontal surface thereof roughly being flush with the zero extension side. The axle of the milling roller extends orthogonally to the moving direction of the road construction machine.

Preferably, the working means is arranged on the rear end of the machine frame and is roughly flush therewith. In this manner, it is possible not only to have the working means work near the edge but even in corners.

The rear support wheels are height-adjustable to adjust the working depth of the working means.

In this context, the rear support wheels and/or the at least one support wheel of the frontal wheel frame axle can be driven.

The pivotable support wheel can be fixed in the respective end positions thereof by means of a locking means. A simple mechanical locking means consists of bolts, for example, which are stuck through parts of the gear and the machine frame.

On the pivotable support wheel, the joints or the joint axles of the guide rod gear are mounted on at least one support plate nonrotatingly connected to the lifting column. In this context, the joints are fixed on the support plate on the side facing the machine frame. The support plate ensures that the support wheel is guided in a stable manner.

The guide rod gear can comprise a driving means consisting of a connecting rod with a linear drive and two guide rods. By operating the linear drive, the pivoting movement of the support wheel can be executed.

In another embodiment, it can be provided that the rear support wheels are steerable.

There now follows a more detailed description of an embodiment of the invention with reference to the accompanying drawings.

Figure 1:
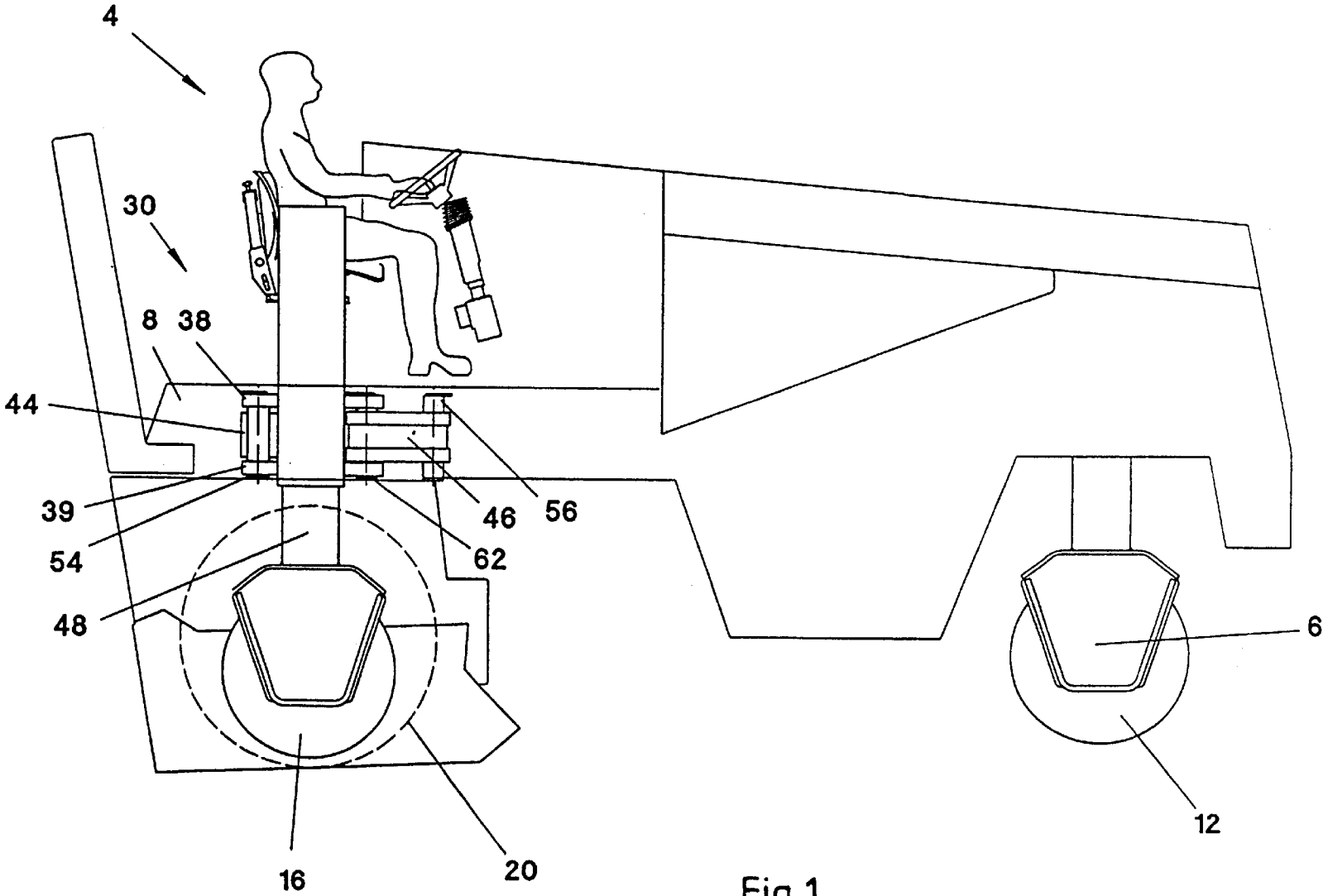
FIG. 1 shows a schematic lateral view of the road construction machine.
Figure 2:
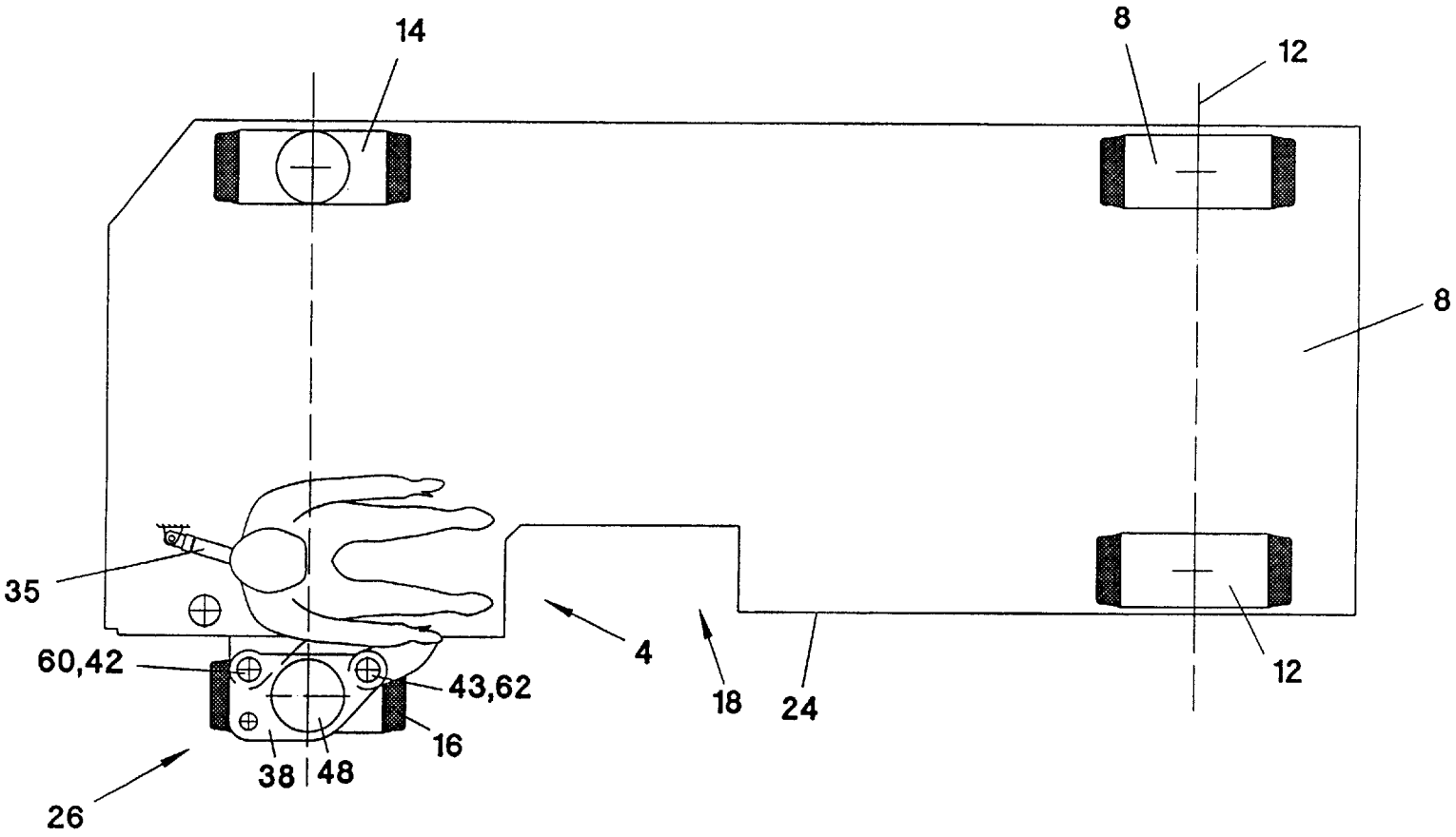
FIG. 2 shows a top plan view of the road construction machine according to FIG. 1.

FIG. 1 shows a road construction machine for milling roadways with an automotive wheel frame consisting of a steerable frontal wheel frame axle 6 with two support wheels 12 driven by a hydromotor and two rear support wheels 14, 16 independent of each other. The wheel frame supports a machine frame 8 whereon a driver's platform 4 on the so-called zero extension side 24 of the road construction machine is located in the height of the axles of the support wheels 14, 16 according to FIG. 2. The rear support wheels 14, 16 are height-adjustable by means of a lifting column 48 to be able to adjust the working depth of a working means 20 consisting of a milling roller.

The milling roller 20 is almost flush, with one frontal surface thereof, with the zero extension side 24 of the machine frame so that it is possible to work near the edge on the zero extension side of the road construction machine. For this purpose, the support wheel 16 is pivoted from an exterior end position 26 beyond the zero extension side plane to the inside into a recess 18 of the machine frame so that the exterior edge of the support wheel 16 is flush with the zero extension side 24.

The support wheels 14, 16 are driven by a hydromotor. The milling roller axle runs, as can best be seen from FIG. 1, in the same vertical plane as the axles of the support wheel 14 and the support wheel 16 in the exterior end position.

The area of engagement of the milling roller ends near the rear end of the machine frame 8 so that milling can occur close to an edge and even in corners.

The pivoting means for the support wheel 16 consists of a guide rod gear 30 with four joints 40, 41, 42, 43 comprising vertical joint axles and two guide rods 44, 46 pivotable in a horizontal plane. Two joints 40, 41 are fixed on the machine frame 8, and two joints 42, 43 are provided on the pivotable support wheel 16 on two respective vertically spaced support plates 38, 39.

Hinge bolts 56, 58, 60, 62 are arranged coaxially to the vertical joint axles.

The guide rod 46 is pivotable, at one end thereof, about the hinge bolt 56 arranged in the machine frame 8 and articulated to the hinge bolts 62 arranged between two vertically spaced support plates 38, 39.

On the side of the machine, the guide rod 44 is pivotable about the hinge bolt 58 which is supported in the machine frame 8, and on the side of the support wheel 16, it is articulated on the hinge bolt 60 arranged between the support plates 38, 39.

Thus, the guide rods 44, 46 move between the vertically spaced support plates 38, 39.

Figure 3A:
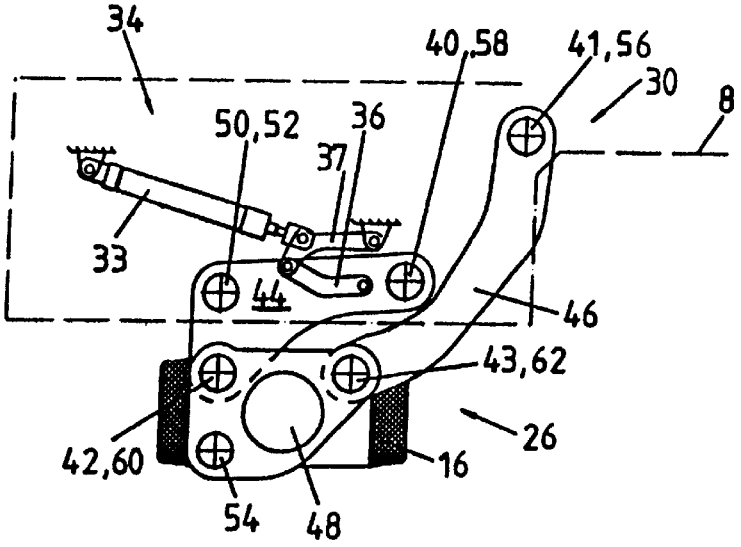
FIG. 3*a* shows a support wheel in an exterior end position.
Figure 3B:
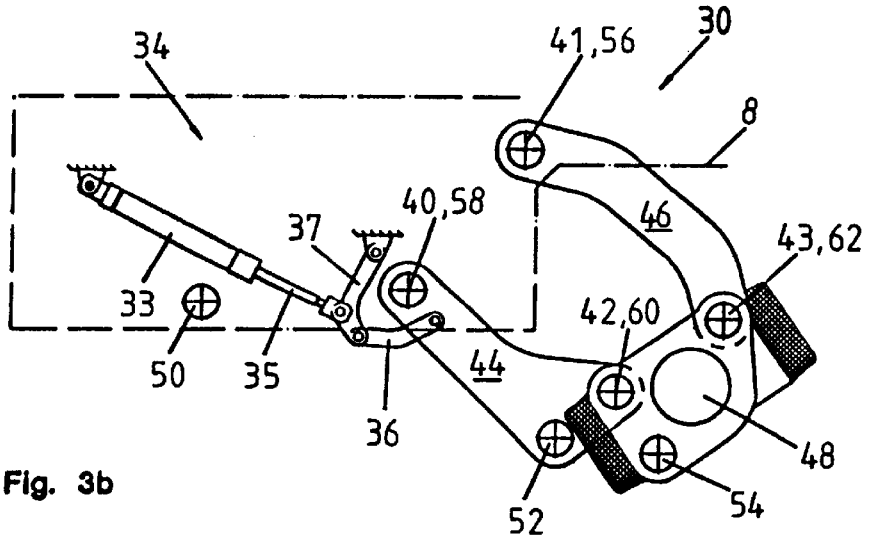
FIG. 3*b* shows the support wheel in an intermediate position.
Figure 3C:
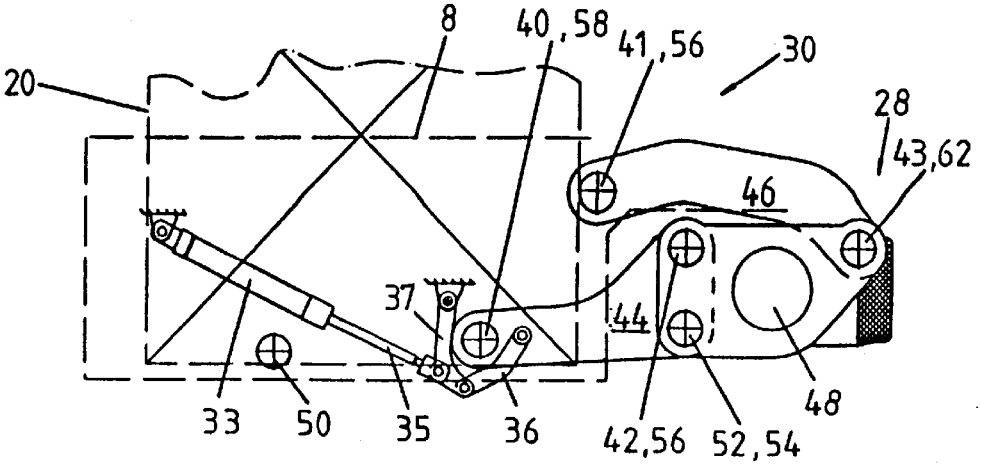
FIG. 3*c* shows the support wheel in the interior end position.

FIG. 3*a* to 3*c* show the pivoting process during which the support wheel 16 is moved from its exterior end position 26 to the interior end position 28 by means of a driving means 34.

The driving means 34 consists of a hydraulic piston/cylinder unit 33 with a connecting rod 35 and two links 36, 37. The link 37 is provided as a two-armed lever, the one end thereof being arranged on the machine frame 8 and the other end thereof being articulated on the second link 36. The other end of the second link 36 is connected to the guide rod 44 of the pivoting means.

The connecting rod 35 can be operated by the driver of the vehicle on the driver's platform 4. In the retracted position of the connecting rod 35, the support wheel 16 is arranged in the exterior end position 26 thereof projecting beyond the zero extension side 24. In the extended state of the connecting rod 35, the guide rod gear 30 is pivoted so that the support wheel 16 can be moved to the interior end position 28. Before the pivoting process takes place, the support wheel 16 is lifted by means of the lifting column 48 so that the support wheel 16 can be pivoted without contact to the floor.

In the respective end positions 26, 28 of the support wheel, the guide rod gear 30 can be fixed by means of a bolt not shown in the drawings and being stuck through the respective locking holes. A locking hole 50 is provided for the exterior end position 26 of the support wheel according to FIG. 3A and is aligned with a through opening 52 in the guide rod 44 in the end position. The bolt can then be stuck through the two openings 50, 52, thus locking the guide rod gear 30.

In the interior end position 28, the guide rod gear 30 is locked by means of locking holes 54 in the support plates 38, 39. In this context, the bolt is stuck through the through opening 52 in the guide rod 44 and through the lower support plate 39. In the end position 28, neither the support wheel 16 nor some other gear element of the guide rod gear projects beyond the zero extension side 24.

As can be seen from FIGS. 3*a* to 3*c*, the support wheel 16 maintains the running direction thereof and is displaced in parallel in the moving direction to the front and to the interior relatively to the exterior end position.

What is claimed is:

1. Road construction machine for the treatment of roadways comprising, an automotive wheel frame consisting of a steerable frontal wheel frame axle (6) with at least one support wheel (12) and two rear support wheels (14, 16), a driver's platform (4) in the area of the rear support wheels (14, 16 ) for a driver of the vehicle on a machine frame (8) supported by the wheel frame, a working means (20) arranged in or on the machine frame (8) which is substantially flush with the machine frame (8) on one side thereof, being a zero extension side (24) thereof, a driving motor for providing the driving power required for driving working means (20) and for moving the road construction machine, the rear support wheel (16) arranged on the zero extension side being pivotable from an exterior end position (26) projecting beyond the zero extension side (24) to a retracted interior end position (28) where the support wheel (16) does not project beyond the zero extension side, the rear support wheel being parallelly displaced between the interior and exterior end positions so that the wheel turns in the same direction in the interior end position as in the exterior end position for each direction of travel, a guide rod gear (30) consisting of a four-link mechanism with four vertical articulated axles (40–43) and two guide rods (40–46) pivotable in a horizontal plane connected to the rear support wheel, the guide rod gear pivoting the rear support wheel from the exterior end position to the retracted interior end position, and drive means connected to the guide rod gear for pivoting the guide rod gear.

2. Road construction machine according to claim 1, characterized in that two joints or articulated axles (40, 41), respectively, are fixed to the machine frame (8) and two joints or articulated axles (42, 43), respectively, are arranged on the pivotable support wheel (16).

3. Road construction machine according to any one of claims 1 or 2 characterized in that the working means (20) consists of a milling roller.

4. Road construction machine according to any one of claims 1 or 2, characterized in that the working means (20) is arranged at the end of the machine frame (8) adjacent to the rear support wheels and is approximately flush with the end of the machine.

5. Road construction machine according to any one of claims 1 or 2, characterized in that the rear support wheels (14, 16) are height-adjustable.

6. Road construction machine according to any one of claims 1 or 2, characterized in that at least one of the rear support wheels (14, 16) or the at least one support wheel (12) are driven.

7. Road construction machine according to claim 1, characterized in that the drive means (34) for the guide rod gear (30) consists of a piston/cylinder unit (33, 35) and two links (36, 37).

8. Road construction machine for the treatment of roadways comprising, an automotive wheel frame consisting of a steerable frontal wheel frame axle (6) with at least one support wheel (12) and two rear support wheels (14, 16), a driver's platform (4) in the area of the rear support wheels (14, 16 ) for a driver of the vehicle on a machine frame (8) supported by the wheel frame, a working means (20) arranged in or on the machine frame (8) which is substantially flush with the machine frame (8) on one side thereof, being a zero extension side (24) thereof, a driving motor for providing the driving power required for driving working means (20) and for moving the road construction machine, the rear support wheel (16) arranged on the zero extension side being pivotable from an exterior end position (26) projecting beyond the zero extension side (24) to a retracted interior end position (28) where the support wheel (16) does not project beyond the zero extension side, the rear support wheel being parallelly displaced between the interior and exterior end positions so that the wheel turns in the same direction in the interior end position as in the exterior end position for each direction of travel, a guide rod gear (30) mounted in a horizontal plane connected to the rear support wheel, the guide rod gear pivoting the rear support wheel from the exterior end position to the retracted interior end position, and drive means connected to the guide rod gear for pivoting the guide rod gear and locking means (50, 52, 54) for retaining the pivotable support wheel (16) in the end positions (26, 28).

9. Road construction machine according to any one of claims 1 or 2, characterized in that the support wheels (14, 16) comprise a lifting column (48) hydraulically operated and nonrotatingly locked due to the cross-sectional shape thereof.

10. Road construction machine according to claim 9, characterized in that the joints or articulated axles (42, 43) are arranged on the pivotable support wheel (16) on at least one support plate (38, 39) connected nonrotatingly to the lifting column (48).

11. Road construction machine according to any one of claims 1 or 8, characterized in that the rear support wheels (14, 16) are steerable.

12. Road construction machine according to any one of claims 1 to 8, characterized in that the guide rod gear (30) is arranged in a plane located below the driver's platform (4).

* * * * *

US006106073C1

(12) EX PARTE REEXAMINATION CERTIFICATE (4924th)

United States Patent

Simons et al.

(10) Number: US 6,106,073 C1

(45) Certificate Issued: Apr. 6, 2004

(54) SHIFTABLE WHEEL FOR ROAD MILLING MACHINE

(75) Inventors: Dieter Simons, Buchholz (DE); Günter Hähn, Königswinter (DE)

(73) Assignee: Wirtgen GmbH, Windhagen (DE)

Reexamination Request:
No. 90/006,196, Jan. 22, 2002

Reexamination Certificate for:

| | |
|---|---|
| Patent No.: | **6,106,073** |
| Issued: | **Aug. 22, 2000** |
| Appl. No.: | **09/043,975** |
| Filed: | **Mar. 31, 1998** |

(22) PCT Filed: Jun. 17, 1997

(86) PCT No.: PCT/EP97/03142

§ 371 (c)(1), (2), (4) Date: Mar. 31, 1998

(87) PCT Pub. No.: WO98/05822

PCT Pub. Date: Feb. 12, 1998

(30) Foreign Application Priority Data

Aug. 1, 1996 (DE) ..... 196 31 042

(51) Int. Cl.[7] ..... E01C 23/088

(52) U.S. Cl. ..... 299/39.6; 299/39.4; 180/209; 404/90

(56) References Cited

U.S. PATENT DOCUMENTS

| | | | | |
|---|---|---|---|---|
| 2,209,804 A | | 7/1940 | Ashley | 280/96.2 |
| 3,188,026 A | * | 6/1965 | Perdue et al. | 244/102 R |
| 3,306,390 A | * | 2/1967 | Jamme | 180/209 |
| 3,971,594 A | * | 7/1976 | Wirtgen | 299/39.6 |
| 4,966,418 A | * | 10/1990 | Wirtgen | 299/39.2 |

FOREIGN PATENT DOCUMENTS

| | | |
|---|---|---|
| DE | 907 838 | 3/1954 |
| FR | 1442426 | 5/1965 |
| FR | 2551015 | 3/1985 |

OTHER PUBLICATIONS

"Surface Miner 3700 SM"; Technical specification, (1997)—submitted by requester.*

Brochure published by Wirtgen entitled "1000 DC Cold Milling Machine", 1991.

Wirtgen 1000 DC Technical Specification, 1991.

"Catalogo Generale" published by Bitelli, Jan. 1996.

*Dubbel handbook of Mechanical Engineering,* 1994.

McGraw–Hill, Inc., *McGraw–Hill Encyclopedia of Engineering, 2nd Edition,* 462–464, 697–700, 1992 New York.

Wilson, Sadler and Michels, *Kinematics and Dynamics of Machinery,* 1983 New York.

* cited by examiner

*Primary Examiner*—Michael Safavi

(57) ABSTRACT

A road construction machine for the treatment of roadways, comprising an automotive wheel frame consisting of a steerable frontal wheel frame axle (6) and two rear support wheels (14, 16) independent from each other, comprising a driver's platform (4), for a driver of the vehicle, arranged in the area of the rear support wheels (14, 16) and on a machine frame (8) supported by the wheel frame, comprising a working means (20) arranged in or on the machine frame (8) and roughly flush with the machine frame (8) on one side, namely the so-called zero extension side (24), comprising a driving motor for the driving power required for driving the driving means (20) and for moving the vehicle, the rear support wheel (16) arranged on the zero extension side being pivotable from an exterior end position (26) projecting beyond the zero extension side (24) to a retracted interior end position (28) where the support wheel (16) does not project beyond the zero extension side, provides that the pivotable support wheel (16) is pivotable from the exterior end position (28) to the interior end position (28) by means of a gear arranged in a horizontal plane.

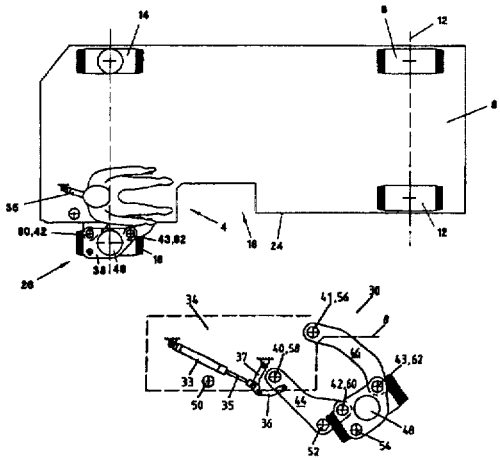

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–12 is confirmed.

* * * * *